US006198368B1

(12) United States Patent
Nam

(10) Patent No.: US 6,198,368 B1
(45) Date of Patent: Mar. 6, 2001

(54) DEFLECTION YOKE

(75) Inventor: Sang Wook Nam, Seoul (KR)

(73) Assignee: Samsung Electro-Mechanics Co., LTD, Kyungki-do (KR)

( * ) Notice: Subject to any disclaimer, the term of this patent is extended or adjusted under 35 U.S.C. 154(b) by 0 days.

(21) Appl. No.: 09/344,185

(22) Filed: Jun. 24, 1999

(30) Foreign Application Priority Data

Sep. 30, 1998 (KR) ..... 98-40786
Feb. 8, 1999 (KR) ..... 99-4283

(51) Int. Cl.[7] ..... H01F 7/00
(52) U.S. Cl. ..... 335/210; 313/440
(58) Field of Search ..... 335/210–213; 313/440–442

(56) References Cited

U.S. PATENT DOCUMENTS 4,998,041 * 3/1991 Hirosima ..... 313/440
5,115,170 * 5/1992 Ose et al. ..... 335/213
5,159,306 * 10/1992 Rousseau ..... 335/210
5,557,165 * 9/1996 Descombes et al. ..... 313/440
5,880,660 * 3/1999 Iwasaki et al. ..... 335/213
5,942,845 * 8/1999 Matsubara ..... 313/440

* cited by examiner

*Primary Examiner*—Lincoln Donovan
*Assistant Examiner*—Tuyen T. Nguyen
(74) *Attorney, Agent, or Firm*—Darby & Darby

(57) ABSTRACT

A deflection yoke comprising a coil separator having a rear plate and a neck part which are defined therein and a printed circuit board which is positioned on a side thereof; at least one horizontal deflecting coil disposed on a circumferential inner surface of the coil separator to produce a horizontal magnetic field and connected to the printed circuit board; at least one vertical deflecting coil disposed on a circumferential outer surface of the coil separator to produce a vertical magnetic field; a ferrite core placed on the circumferential outer surface of the coil separator to reinforce the horizontal and vertical magnetic fields of the horizontal and vertical deflecting coils; insulating means defined on an inside surface of the coil separator to prevent a short from being generated due to a contact between one end and the other end of the horizontal deflecting coil connected to the printed circuit board; and coil distance maintaining means defined on an outer surface of a side of the coil separator to secure a safe distance between the horizontal and vertical deflecting coils of the rear plate, to isolate the horizontal and vertical deflecting coils from each other.

7 Claims, 9 Drawing Sheets

DEFLECTION YOKE

BACKGROUND OF THE INVENTION

1. Field of the Invention

The present invention relates to a deflection yoke, and more particularly, the present invention relates to a deflection yoke which improves picture dispersion due to assembling dispersion of a vertical deflecting coil and improves winding structures of the vertical deflecting coil and a horizontal deflecting coil.

2. Description of the Related Art

Generally, a deflection yoke used in a cathode ray tube (CRT) of a television receiver or a monitor is divided into a saddle-toroid type deflection yoke and a saddle-saddle type deflection yoke and functions to precisely deflect electron beams emitted from electron guns onto a fluorescent layer applied on a screen of a cathode ray tube.

In other words, as shown in FIG. 1, the conventional deflection yoke 10 is fitted around a neck part 2 of a cathode ray tube 1. As described above, the deflection yoke 10 is divided into a saddle-saddle type deflection yoke as shown in FIGS. 2 and 3 and a saddle-toroid type deflection yoke as shown in FIGS. 4 and 5, depending upon a winding structure of a coil thereof.

The deflection yoke 10 serves to horizontally and vertically deflect electron beams emitted from BGR electron guns 3 which are disposed in the neck part 2 of the cathode ray tube 1, thereby to precisely focus the electron beams onto a fluorescent layer of the cathode ray tube 1.

FIGS. 2 and 3 illustrate the conventional saddle-saddle type deflection yoke. As can be seen from FIGS. 2 and 3, in the saddle-saddle type deflection yoke, horizontal deflection coils 12 having a saddle-shaped configuration are disposed on upper and lower portions of a circumferential inner surface of a screen part of a coil separator 11 having a substantially frusto-conical configuration, and vertical deflecting coils 13 having a saddle-shaped configuration are disposed on left and right portions of a circumferential outer surface of the screen part of the coil separator 11.

A ferrite core 14 having a substantially cylindrical configuration is placed on the circumferential outer surface of the screen part of the coil separator 11, to reinforce a magnetic field of the vertical deflecting coils 13.

Also, coma-free coils 15 are arranged adjacent the circumference of the neck part of the coil separator 11, to compensate for coma which is generated by the vertical deflecting coils 13.

FIGS. 4 and 5 illustrate the conventional saddle-toroid type deflection yoke. As can be seen from FIGS. 4 and 5, in the saddle-toroid type deflection yoke, horizontal deflection coils 12 are disposed on upper and lower portions of a circumferential inner surface of a screen part of a coil separator 11 having a substantially frusto-conical configuration, a ferrite core 14 having a substantially cylindrical configuration is placed on a circumferential outer surface of the screen part of the coil separator 11, and vertical deflecting coils 16 having a toroid-shaped configuration are disposed on upper and lower portions of the ferrite core 14.

Further, coma-free coils 15 are additionally arranged adjacent the circumference of the neck part of the coil separator 11, to compensate for coma which is generated by the vertical deflecting coils 16.

Moreover, in the saddle-saddle type deflection yoke and the saddle-toroid type deflection yoke, a printed circuit board is positioned on a side of the coil separator 11, to supply power to the horizontal deflecting coils 12 and the vertical deflecting coils 13 and 16.

However, the conventional deflection yokes suffer from defects as described below.

In other words, in the process of coupling the ferrite core 14 around which the vertical deflecting coils 13 are wound, onto the circumferential outer surface of the coil separator 11 which has the horizontal deflecting coils 12 mounted onto the circumferential inner surface thereof, using a core clamp (not shown), the ferrite core 14 may be fluctuated due to its dimensional dispersion, winding dispersion of the vertical deflecting coil 13, etc. That is to say, the ferrite core 14 may be fluctuated on the coil separator 11 in a transverse or longitudinal direction even by a light impact.

As described above, if the ferrite core 14 around which the vertical deflecting coils 13 are wound, is fluctuated on the coil separator 11, because the vertical deflecting coils 13 cannot be precisely concentrically aligned with the coil separator 11, stable axial balance may not be ensured, whereby distortion is caused on a picture.

Namely, in the saddle-saddle type deflection yoke, there is caused a difference between the left magnetic field and the right magnetic field, due to relative dispersion and/or relative current amount between the left vertical deflecting coils and the right vertical deflecting coils, whereby mis-convergence and geometrical distortion (G/D) are generated on a picture.

Similarly to this, also in the saddle-toroid type deflection yoke, there is caused a difference between the left magnetic field and the right magnetic field, due to relative dispersion and/or relative current amount between the vertical deflecting coils 16 disposed on left upper and lower portions of the ferrite core 14 and the vertical deflecting coils 16 disposed on right upper and lower portions of the ferrite core 14, on X-Y axes, whereby mis-convergence and geometrical distortion (G/D) are generated on a picture.

The mis-convergence is divided into YV mis-convergence and YHC mis-convergence. The YV mis-convergence represents a vertical mis-convergence in which a transverse line of red color R is not in line with a transverse line of blue color B on upper and lower portions of Y axis as shown in FIGS. 6 and 7, and the YHC mis-convergence represents a horizontal misconvergence in which a longitudinal line of red color R is crossed with a longitudinal line of blue color B as shown in FIG. 8.

The geometrical distortion (G/D) represents a state in which a picture is not normal but distorted as shown in FIGS. 9 and 10 which specifically illustrate trapezoidal distortion of a picture.

In order to solve the problems occurring in the related art, as shown in FIG. 11, a plurality of elastic wedges 20 which are made of sponge, are attached on the circumferential outer surface of the coil separator 11 such that they are uniformly spaced apart one from another in a circumferential direction, to elastically bias outward the ferrite core 14 which is placed on the circumferential outer surface of the coil separator 11, whereby assembling dispersion is reduced to overcome the defects described with reference to FIGS. 2 through 10.

However, in the method for maintaining axial balance of the vertical deflecting coils 13 using the plurality of elastic wedges 20, because the elastic wedges 20 are deformed by themselves to a great extent, high dimensional precision cannot be accomplished, and according to this, dimensional dispersion is enlarged, whereby it is difficult to actually achieve the axial balance of the vertical deflecting coils 13.

Further, since the plurality of elastic wedges 20 are attached to the circumferential outer surface of the coil separator 11 by applying adhesive, attachment position varies relying upon a worker, by which attachment position dispersion is enlarged, whereby it is further difficult to stably achieve the axial balance of the vertical deflecting coils 13.

In addition, because the plurality of elastic wedges 20 are used, the number of components and cost are increased, and because the number of work steps including adhesive applying step for attaching the plurality of elastic wedges 20 is increased, workability and productivity are deteriorated.

Moreover, while one end and the other end of the horizontal deflecting coil 12 must be connected to the printed circuit board when it is disposed on the circumferential inner surface of the coil separator 11, because pick-off positions are close to each other, one end and the other end of the horizontal deflecting coil 12 may be brought into contact with each other due to an inadvertence of a worker thereby to cause a short and an electric shock, and in the course of connecting the vertical deflecting coils 13 and 16 to the printed circuit board, a short and an electric shock can be generated due to a contact between the horizontal deflecting coil 12 and the vertical deflecting coils 13 and 16.

SUMMARY OF THE INVENTION

Accordingly, the present invention has been made in an effort to solve the problems occurring in the related art, and an object of the present invention is to provide a deflection yoke which can prevent a ferrite core from fluctuating to improve picture dispersion and can prevent a short and an electric shock from being generated when winding horizontal and vertical deflecting coils.

According to one aspect of the present invention, there is provided a deflection yoke comprising: a coil separator having a rear plate and a neck part which are defined therein and a printed circuit board which is positioned on a side thereof; at least one horizontal deflecting coil disposed on a circumferential inner surface of the coil separator to produce a horizontal magnetic field and connected to the printed circuit board; at least one vertical deflecting coil disposed on a circumferential outer surface of the coil separator to produce a vertical magnetic field; a ferrite core placed on the circumferential outer surface of the coil separator to reinforce the horizontal and vertical magnetic fields of the horizontal and vertical deflecting coils; and insulating means defined on an inside surface of the coil separator to prevent a short from being generated due to a contact between one end and the other end of the horizontal deflecting coil connected to the printed circuit board.

According to another aspect of the present invention, the insulating means is provided between boundary surfaces of coil separator halves which are assembled with each other.

According to another aspect of the present invention, the insulating means comprises a separating piece which is formed on one boundary surface of one coil separator half such that it extends toward the other boundary surface of the other coil separator half, to separate over and under one end and the other end of the horizontal deflecting coil.

According to another aspect of the present invention, there is provided a deflection yoke comprising: a coil separator having a rear plate and a neck part which are defined therein and a printed circuit board which is positioned on a side thereof; at least one horizontal deflecting coil disposed on a circumferential inner surface of the coil separator to produce a horizontal magnetic field and connected to the printed circuit board; at least one vertical deflecting coil disposed on a circumferential outer surface of the coil separator to produce a vertical magnetic field; a ferrite core placed on the circumferential outer surface of the coil separator to reinforce the horizontal and vertical magnetic fields of the horizontal and vertical deflecting coils; and coil distance maintaining means defined on an outer surface of a side of the coil separator to secure a safe distance between the horizontal and vertical deflecting coils.

According to another aspect of the present invention, the coil distance maintaining means comprises an isolating piece which is formed on an outer surface of a side of a plate of the coil separator plate such that it extends while maintaining a predetermined distance from an outer surface of the rear plate, to isolate the horizontal and vertical deflecting coils from each other.

According to another aspect of the present invention, there is provided a deflection yoke comprising: a coil separator having a rear plate and a neck part which are defined therein and a printed circuit board which is positioned on a side thereof; at least one horizontal deflecting coil disposed on a circumferential inner surface of the coil separator to produce a horizontal magnetic field and connected to the printed circuit board; at least one vertical deflecting coil disposed on a circumferential outer surface of the coil separator to produce a vertical magnetic field; a ferrite core placed on the circumferential outer surface of the coil separator to reinforce the horizontal and vertical magnetic fields of the horizontal and vertical deflecting coils; insulating means defined on an inside surface of the coil separator to prevent a short from being generated due to a contact between one end and the other end of the horizontal deflecting coil connected to the printed circuit board; and coil distance maintaining means defined on an outer surface of a side of the coil separator to secure a safe distance between the horizontal and vertical deflecting coils.

According to another aspect of the present invention, the insulating means is provided between boundary surfaces of coil separator halves which are assembled with each other.

According to another aspect of the present invention, the insulating means comprises a separating piece which is formed on one boundary surface of one coil separator half such that it extends toward the other boundary surface of the other coil separator half, to separate over and under one end and the other end of the horizontal deflecting coil.

According to another aspect of the present invention, the coil distance maintaining means comprises an isolating piece which is formed on an outer surface of a side of a plate of the coil separator plate such that it extends while maintaining a predetermined distance from an outer surface of the rear plate, to isolate the horizontal and vertical deflecting coils from each other.

According to another and vertical deflecting coils.

According to another aspect of the present invention, the insulating means is provided between boundary surfaces of coil separator halves which are assembled with each other.

According to another aspect of the present invention, the insulating means comprises a separating piece which is formed on one boundary surface of one coil separator half such that it extends toward the other boundary surface of the other coil separator half, to separate over and under one end and the other end of the horizontal deflecting coil.

According to another aspect of the present invention, the coil distance maintaining means comprises an isolating piece which is formed on an outer surface of a side of a plate of the coil separator plate such that it extends while maintaining a predetermined distance from an outer surface of the rear plate, to isolate the horizontal and vertical deflecting coils from each other.

According to another surface of a side of the coil separator to secure a safe distance between the horizontal and vertical deflecting coils; and fluctuation preventing means defined on the coil separator such that it has a predetermined elasticity, to elastically support inner surfaces of the pair of grooves of the ferrite core thereby to prevent the ferrite core from fluctuating when the ferrite core is coupled to the coil separator.

According to another aspect of the present invention, the insulating means is provided between boundary surfaces of coil separator halves which are assembled with each other.

According to another aspect of the present invention, the insulating means comprises a separating piece which is formed on one boundary surface of one coil separator half such that it extends toward the other boundary surface of the other coil separator half, to separate over and under one end and the other end of the horizontal deflecting coil.

According to still another aspect of the present invention, the coil distance maintaining means comprises an isolating piece which is formed on an outer surface of a side of a plate of the coil separator plate such that it extends while maintaining a predetermined distance from an outer surface of the rear plate, to isolate the horizontal and vertical deflecting coils from each other.

According to yet still another aspect of the present invention, the fluctuation preventing means comprises at least two pairs of elastic projections which are formed such that the two pairs extend from an upper inside surface and a lower inside surface of the coil separator, respectively, and correspond to the pair of grooves formed in the ferrite core, respectively, with two elastic projections of each pair extending parallel to each other, the two pairs of elastic projections being elastically fitted into the pair of grooves of the ferrite core, respectively, to compensate for a width tolerance range of 0.1 mm–1.0 mm, which each groove of the ferrite core has.

BRIEF DESCRIPTION OF THE DRAWINGS

The above objects, and other features and advantages of the present invention will become more apparent after a reading of the following detailed description when taken in conjunction with the drawings, in which.

DETAILED DESCRIPTION OF PREFERRED EMBODIMENTS

Figure 1:
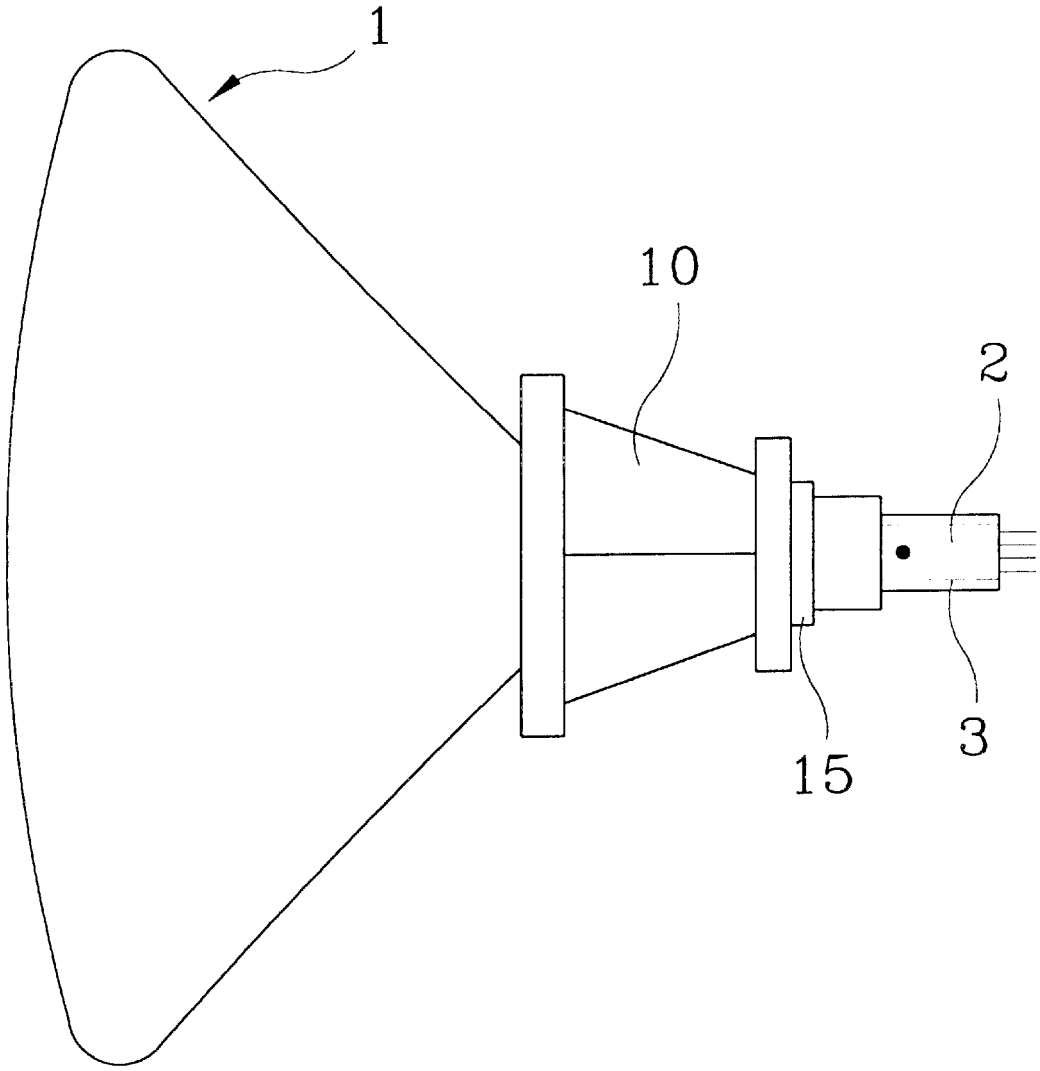
FIG. 1 PRIOR ART
FIG. 1 is a side view of the conventional deflection yoke.

Reference will now be made in greater detail to a preferred embodiment of the invention, an example of which is illustrated in the accompanying drawings. Wherever possible, the same reference numerals will be used throughout the drawings and the description to refer to the same or like parts.

A deflection yoke in accordance with a first embodiment of the present invention will be described first with reference to FIGS. 2 through 5 and then with reference to FIGS. 12 and 13.

Figure 2:
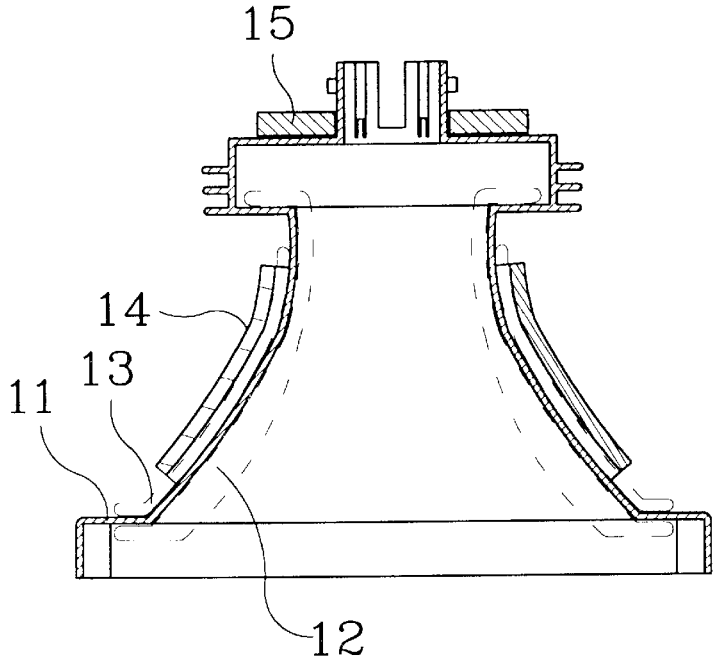
FIG. 2 PRIOR ART
FIGS. 2 and 3 are longitudinal and transverse sectional views, respectively, illustrating the conventional saddle-saddle type deflection yoke.
Figure 3:
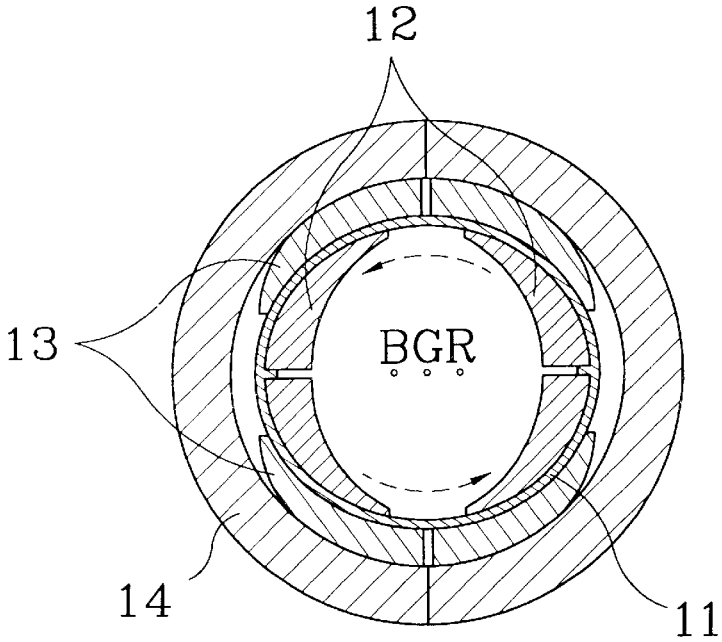
FIG. 3 PRIOR ART

FIGS. 2 and 3 illustrate the conventional saddle-saddle type deflection yoke. As can be seen from FIGS. 2 and 3, in the saddle-saddle type deflection yoke, horizontal deflection coils 12 having a saddle-shaped configuration are disposed on upper and lower portions of a circumferential inner surface of a screen part of a coil separator 11 having a substantially frusto-conical configuration, and vertical deflecting coils 13 having a saddle-shaped configuration are disposed on left and right portions of a circumferential outer surface of the screen part of the coil separator 11.

A ferrite core 14 having a substantially cylindrical configuration is placed on the circumferential outer surface of the screen part of the coil separator 11 to reinforce a magnetic field of the vertical deflecting coils 13.

Also, coma-free coils 15 are arranged adjacent the circumference of the neck part of the coil separator 11, that is, on a rear plate 11*a*, to compensate for coma which is generated by the vertical deflecting coils 13.

Figure 4:
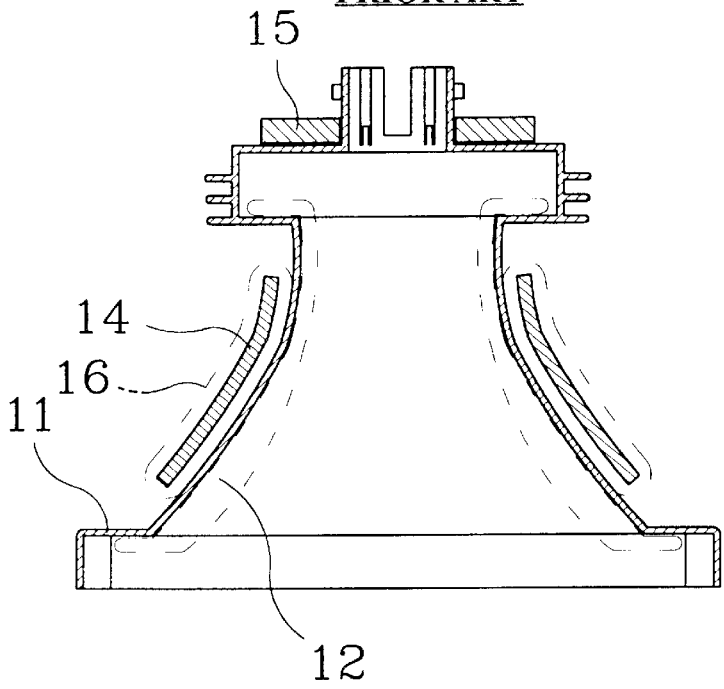
FIG. 4 PRIOR ART
FIGS. 4 and 5 are longitudinal and transverse sectional views, respectively, illustrating the conventional saddle-toroid type deflection yoke.
Figure 5:
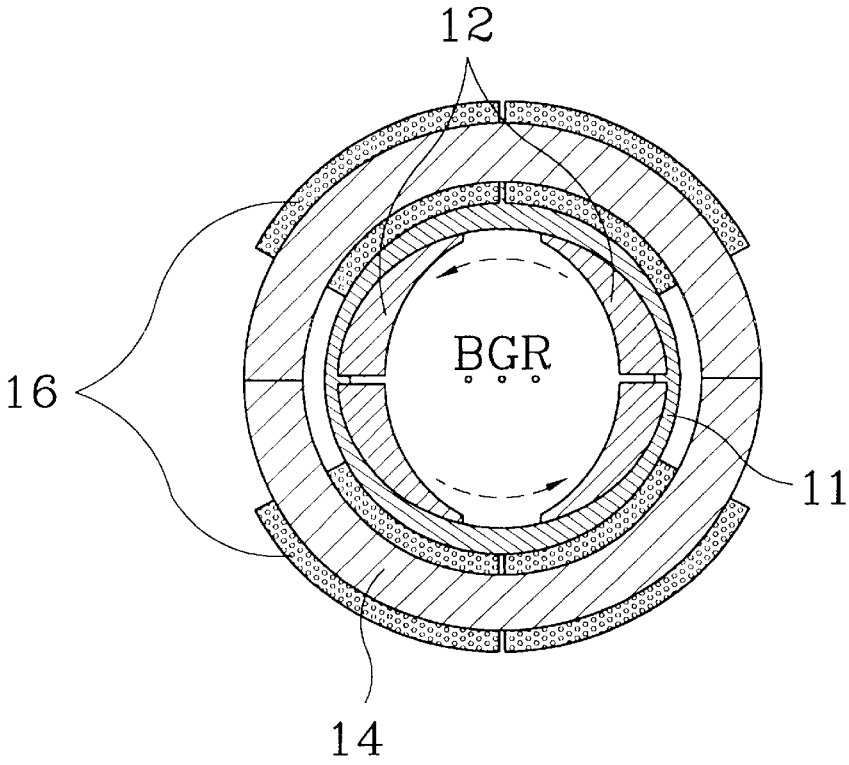
FIG. 5 PRIOR ART
Figure 6:
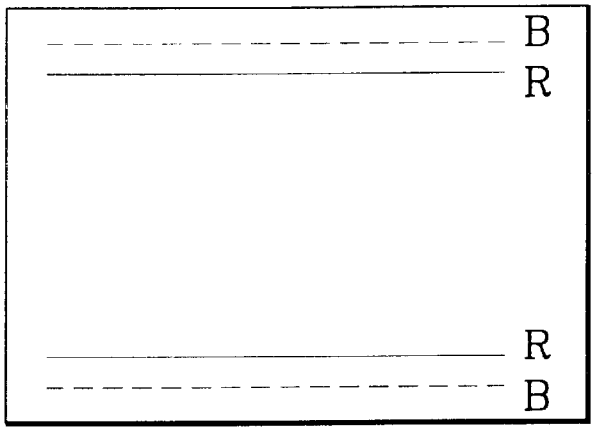
FIG. 6 PRIOR ART
FIGS. 6 through 10 are views for explaining a misconvergence pattern and a geometrical distortion pattern on a picture.
Figure 7:
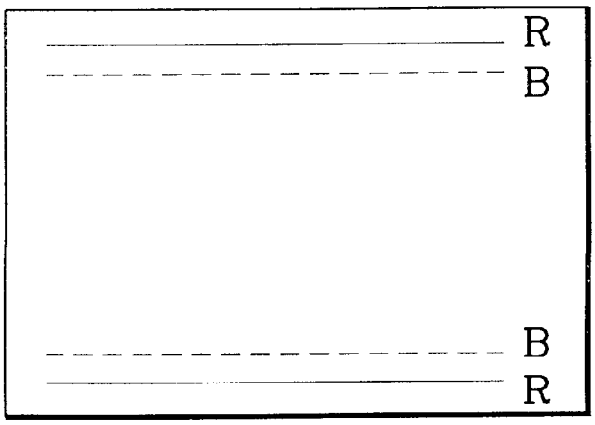
FIG. 7 PRIOR ART
Figure 8:
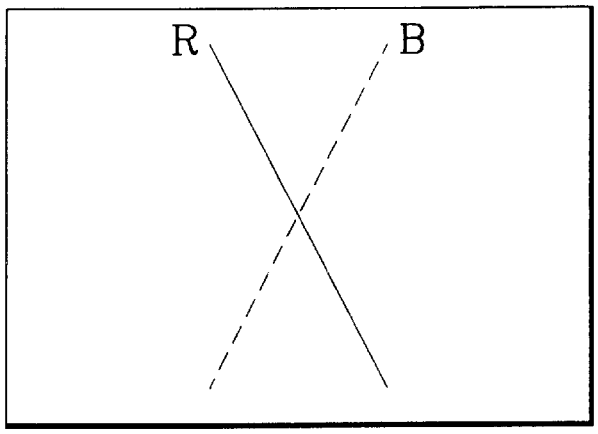
FIG. 8 PRIOR ART
Figure 9:
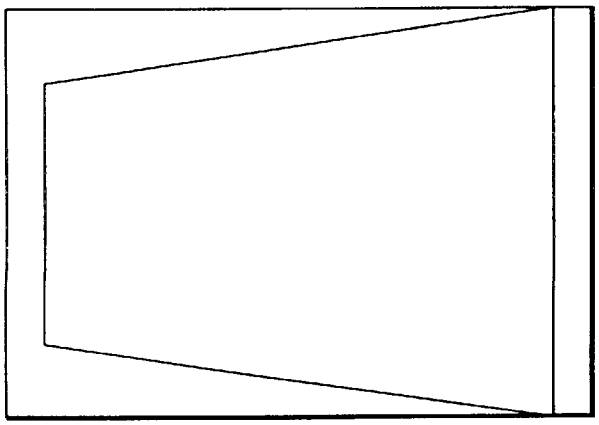
FIG. 9 PRIOR ART
Figure 10:
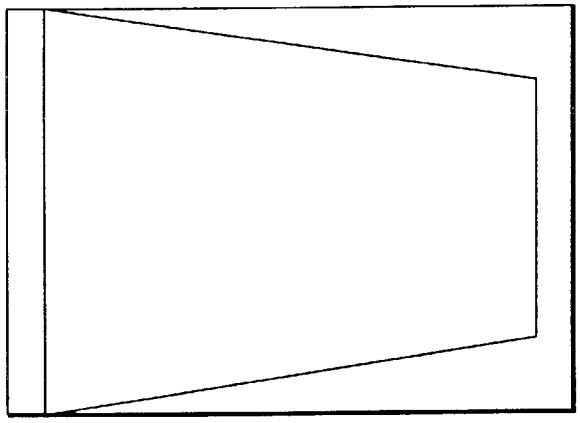
FIG. 10 PRIOR ART
Figure 11:
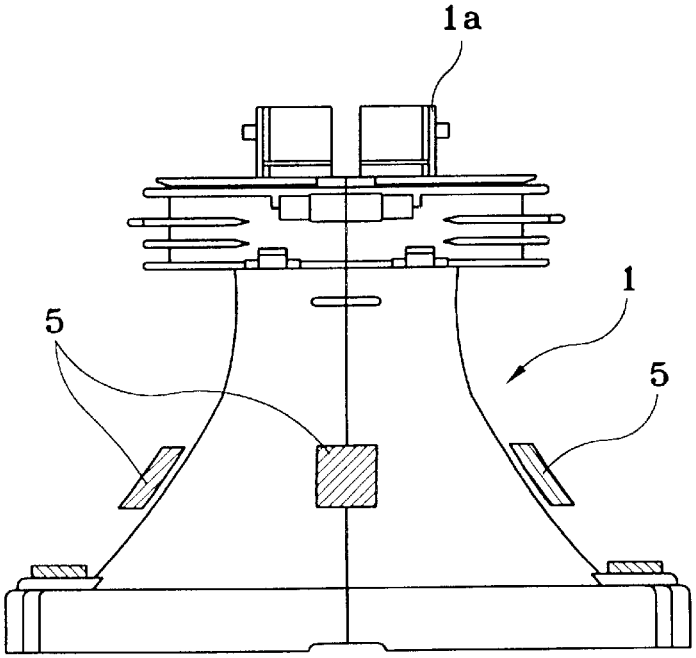
FIG. 11 PRIOR ART
FIG. 11 is a front view illustrating main components of the conventional deflection yoke.

FIGS. 4 and 5 illustrate the conventional saddle-toroid type deflection yoke. As can be seen from FIGS. 4 and 5, in the saddle-toroid type deflection yoke, horizontal deflection coils 12 are disposed on upper and lower portions of a circumferential inner surface of a screen part of a coil separator 11 having a substantially frusto-conical configuration, a ferrite core 14 having a substantially cylindrical configuration is placed on a circumferential outer surface of the screen part of the coil separator 11, and vertical deflecting coils 16 having a toroid-shaped configuration are disposed on upper and lower portions of the ferrite core 14.

Further, coma-free coils 15 are additionally arranged adjacent the circumference of the neck part of the coil separator 11, to compensate for coma which is generated by the vertical deflecting coils 16.

Moreover, in the saddle-saddle type deflection yoke and the saddle-toroid type deflection yoke, a printed circuit board 17 is positioned on a side of the coil separator 11, to supply power to the horizontal deflecting coils 12 and the vertical deflecting coils 13 and 16.

Figure 12:
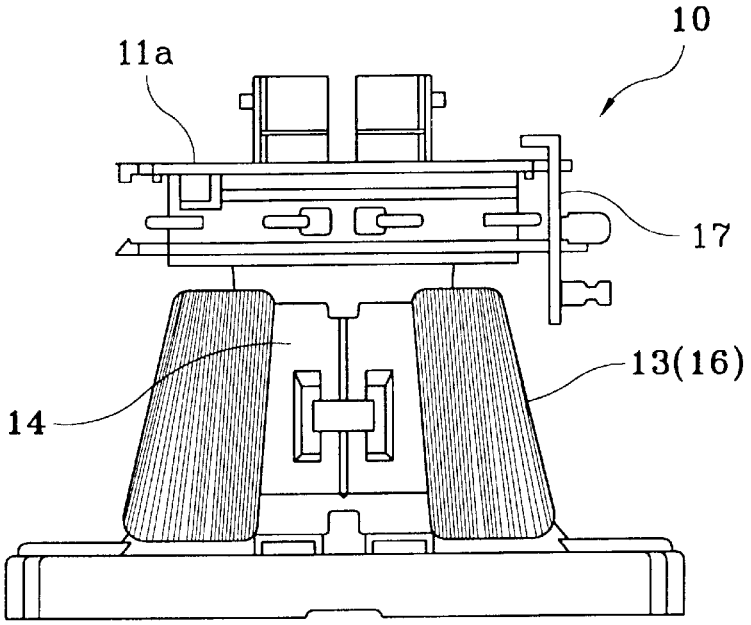
FIGS. 12 and 15 are front views illustrating deflection yokes in accordance with several embodiments of the present invention.

Referring to FIG. 12, insulating means is defined on an inside surface of the coil separator 11, to prevent one end and the other end of the horizontal deflecting coil 12 connected to the printed circuit board 17 from being brought into contact with each other, that is, to prevent a short from being generated.

The insulating means is provided between boundary surfaces of coil separator halves which are assembled with each other to complete the coil separator 11. As the insulating means, as shown in FIG. 13, a separating piece 100 is formed on one boundary surface of one coil separator half such that it extends toward the other boundary surface of the other coil separator half.

Accordingly, since one end and the other end of the horizontal deflecting coil 12 are connected to the printed circuit board 17 in a state that they are separated over and under while centering around the separating piece 100, it is possible to prevent a short and an electric shock due to a contact between one end and the other end of the horizontal deflecting coil 12, which can be otherwise generated in a coil connecting process.

A deflection yoke in accordance with a second embodiment of the present invention will be described first with reference to the first embodiment of the present invention and then with reference to FIGS. 12 through 14.

FIGS. 2 and 3 illustrate the conventional saddle-saddle type deflection yoke. As can be seen from FIGS. 2 and 3, in the saddle-saddle type deflection yoke, horizontal deflection coils 12 having a saddle-shaped configuration are disposed on upper and lower portions of a circumferential inner surface of a screen part of a coil separator 11 having a substantially frusto-conical configuration, and vertical deflecting coils 13 having a saddle-shaped configuration are disposed on left and right portions of a circumferential outer surface of the screen part of the coil separator 11.

A ferrite core 14 having a substantially cylindrical configuration is placed on the circumferential outer surface of the screen part of the coil separator 11, to reinforce a magnetic field of the vertical deflecting coils 13.

Also, coma-free coils 15 are arranged adjacent the circumference of the neck part of the coil separator 11, that is, on a rear plate 11*a*, to compensate for coma which is generated by the vertical deflecting coils 13.

FIGS. 4 and 5 illustrate the conventional saddle-toroid type deflection yoke. As can be seen from FIGS. 4 and 5, in the saddle-toroid type deflection yoke, horizontal deflection coils 12 are disposed on upper and lower portions of a circumferential inner surface of a screen part of a coil separator 11 having a substantially frusto-conical configuration, a ferrite core 14 having a substantially cylindrical configuration is placed on a circumferential outer surface of the screen part of the coil separator 11, and vertical deflecting coils 16 having a toroid-shaped configuration are disposed on upper and lower portions of the ferrite core 14.

Further, coma-free coils 15 are additionally arranged adjacent the circumference of the neck part of the coil separator 11, to compensate for coma which is generated by the vertical deflecting coils 16.

Moreover, in the saddle-saddle type deflection yoke and the saddle-toroid type deflection yoke, a printed circuit board 17 as shown in FIG. 12 is positioned on a side of the coil separator 11, to supply power to the horizontal deflecting coils 12 and the vertical deflecting coils 13 and 16.

Coil distance maintaining means is defined on an outer surface of the coil separator 11 to secure a safe distance between the horizontal and vertical deflecting coils 12 and 13, that is, to prevent the horizontal and vertical deflecting coils 12 and 13 from being brought into contact with each other.

Figure 13:
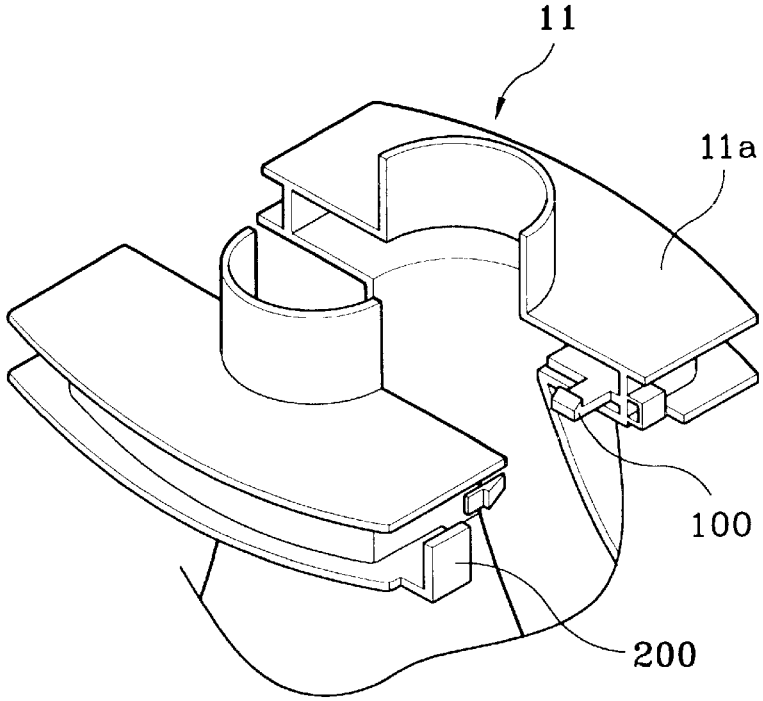
FIGS. 13 and 14 are a partial perspective view and a cross-sectional view, respectively, of the deflection yoke of FIG. 12.
Figure 14:
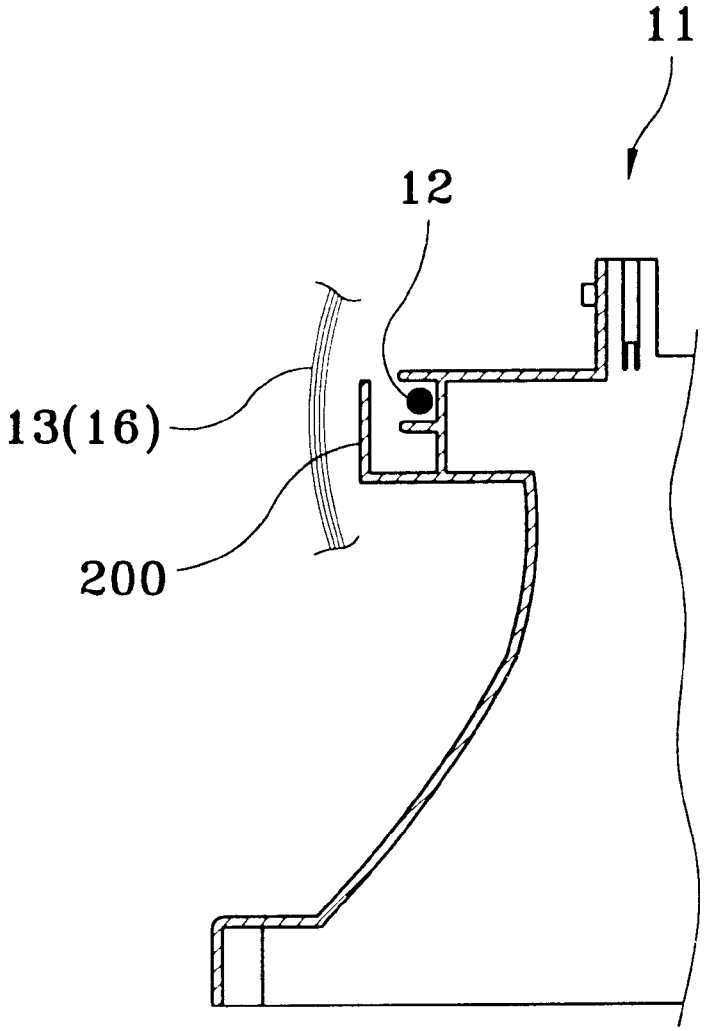

Namely, as shown in FIGS. 13 and 14, an isolating piece 200 extends from the outer surface of the coil separator 11 by a predetermined distance.

At this time, the isolating piece 200 is formed such that the predetermined distance is maintained between it and an outer surface of the rear plate 11*a* of the coil separator 11.

Accordingly, by causing the horizontal deflecting coils 12 and the vertical deflecting coils 13 to be guided on the outer surface of the rear plate 11*a* and an outer surface of the isolating piece 200, respectively, a safe distance can be sufficiently secured between the horizontal deflecting coils 12 and the vertical deflecting coils 13.

A deflection yoke in accordance with a third embodiment of the present invention will be described with reference to the first and second embodiments of the present invention.

FIGS. 2 and 3 illustrate the conventional saddle-saddle type deflection yoke. As can be seen from FIGS. 2 and 3, in the saddle-saddle type deflection yoke, horizontal deflection coils 12 having a saddle-shaped configuration are disposed on upper and lower portions of a circumferential inner surface of a screen part of a coil separator 11 having a substantially frusto-conical configuration, and vertical deflecting coils 13 having a saddle-shaped configuration are disposed on left and right portions of a circumferential outer surface of the screen part of the coil separator 11.

A ferrite core 14 having a substantially cylindrical configuration is placed on the circumferential outer surface of the screen part of the coil separator 11, to reinforce a magnetic field of the vertical deflecting coils 13.

Also, coma-free coils 15 are arranged adjacent the circumference of the neck part of the coil separator 11, that is, on a rear plate 11*a*, to compensate for coma which is generated by the vertical deflecting coils 13.

FIGS. 4 and 5 illustrate the conventional saddle-toroid type deflection yoke. As can be seen from FIGS. 4 and 5, in the saddle-toroid type deflection yoke, horizontal deflection coils 12 are disposed on upper and lower portions of a circumferential inner surface of a screen part of a coil separator 11 having a substantially frusto-conical configuration, a ferrite core 14 having a substantially cylindrical configuration is placed on a circumferential outer surface of the screen part of the coil separator 11, and vertical deflecting coils 16 having a toroid-shaped configuration are disposed on upper and lower portions of the ferrite core 14.

Further, coma-free coils 15 are additionally arranged adjacent the circumference of the neck part of the coil separator 11, to compensate for coma which is generated by the vertical deflecting coils 16.

Moreover, in the saddle-saddle type deflection yoke and the saddle-toroid type deflection yoke, a printed circuit board 17 as shown in FIG. 12 is positioned on a side of the coil separator 11, to supply power to the horizontal deflecting coils 12 and the vertical deflecting coils 13 and 16.

Referring to FIG. 12, insulating means is defined on an inside surface of the coil separator 11, to prevent one end and the other end of the horizontal deflecting coil 12 connected to the printed circuit board 17 from being brought into contact with each other, that is, to prevent a short from being generated.

Coil distance maintaining means is defined on an outer surface of the coil separator 11 to secure a safe distance between the horizontal and vertical deflecting coils 12 and 13, that is, to prevent the horizontal and vertical deflecting coils 12 and 13 from being brought into contact with each other.

The above mentioned insulating means is provided between boundary surfaces of coil separator halves which are assembled with each other to complete the coil separator 11. As the insulating means, as shown in FIG. 13, a separating piece 100 is formed on one boundary surface of one coil separator half such that it extends toward the other boundary surface of the other coil separator half.

Accordingly, since one end and the other end of the horizontal deflecting coil 12 are connected to the printed circuit board 17 in a state that they are separated over and under while centering around the separating piece 100, it is possible to prevent a short and an electric shock due to a contact between one end and the other end, which can be otherwise generated in a coil connecting process.

When deliberating a detailed construction of the coil distance maintaining means for securing a safe distance between the horizontal and vertical deflecting coils 12 and 13, as shown in FIGS. 13 and 14, an isolating piece 200 extends from the outer surface of the coil separator 11 by a predetermined distance.

At this time, the isolating piece 200 is formed such that the predetermined distance is maintained between it and an outer surface of the rear plate 11*a* of the coil separator 11.

Accordingly, by causing the horizontal deflecting coils 12 and the vertical deflecting coils 13 to be guided on the outer surface of the rear plate 11*a* and an outer surface of the isolating piece 200, respectively, a safe distance can be sufficiently secured between the horizontal deflecting coils 12 and the vertical deflecting coils 13.

As described above, by the present invention, winding operations of the horizontal and vertical deflecting coils 12 and 13 and leading operations thereof to the printed circuit board 17 can be stably performed through the separating piece 100 and the isolating piece 200 which are defined on the coil separator 11, and specifically, a short and an electric shock can be prevented from being generated.

Figure 15:
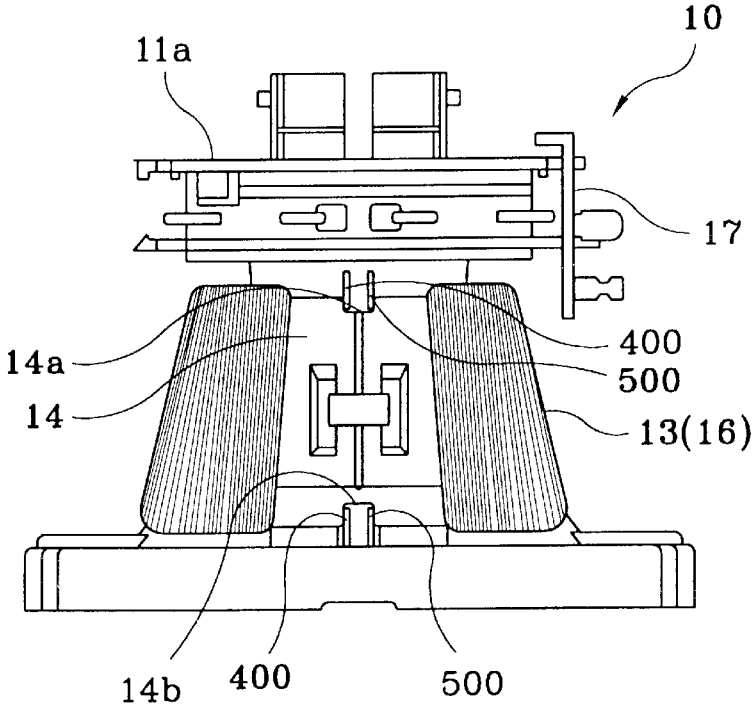
Figure 16:
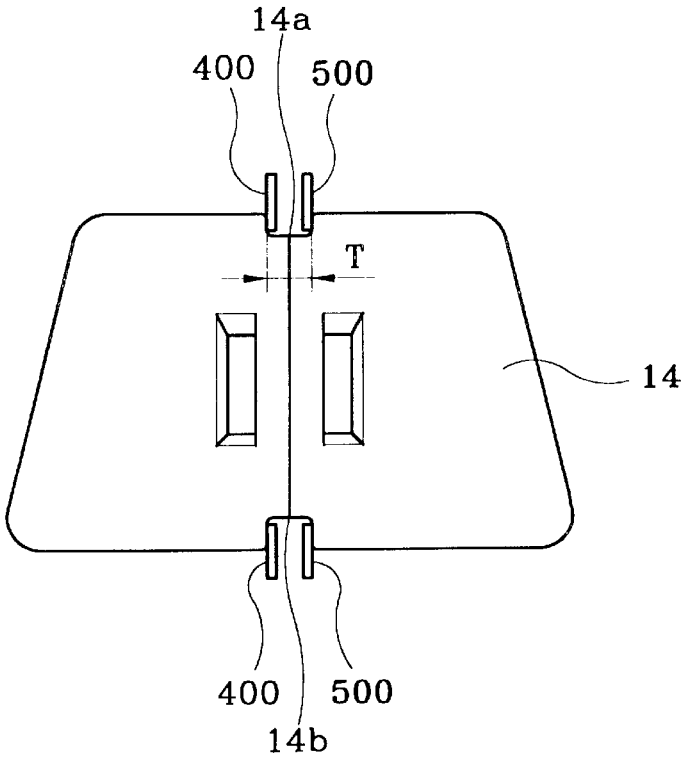
FIG. 16 is a front view of main components of the deflection yoke of FIG. 15, illustrating a coupled state of a ferrite core.

A deflection yoke in accordance with a fourth embodiment of the present invention will be described first with reference to the first through third embodiments of the present invention and then with reference to FIGS. 15 and 16.

FIGS. 2 and 3 illustrate the conventional saddle-saddle type deflection yoke. As can be seen from FIGS. 2 and 3, in the saddle-saddle type deflection yoke, horizontal deflection coils 12 having a saddle-shaped configuration are disposed on upper and lower portions of a circumferential inner surface of a screen part of a coil separator 11 having a substantially frusto-conical configuration, and vertical deflecting coils 13 having a saddle-shaped configuration are disposed on left and right portions of a circumferential outer surface of the screen part of the coil separator 11.

A ferrite core 14 having a substantially cylindrical configuration is placed on the circumferential outer surface of the screen part of the coil separator 11, to reinforce a magnetic field of the vertical deflecting coils 13.

Also, coma-free coils 15 are arranged adjacent the circumference of the neck part of the coil separator 11, that is, on a rear plate 11*a*, to compensate for coma which is generated by the vertical deflecting coils 13.

FIGS. 4 and 5 illustrate the conventional saddle-toroid type deflection yoke. As can be seen from FIGS. 4 and 5, in the saddle-toroid type deflection yoke, horizontal deflection coils 12 are disposed on upper and lower portions of a circumferential inner surface of a screen part of a coil separator 11 having a substantially frusto-conical configuration, a ferrite core 14 having a substantially cylindrical configuration is placed on a circumferential outer surface of the screen part of the coil separator 11, and vertical deflecting coils 16 having a toroid-shaped configuration are disposed on upper and lower portions of the ferrite core 14.

A pair of grooves 14*a* and 14*b* having a predetermined width and a predetermined depth are formed on central upper and lower surfaces of the ferrite core 14, respectively.

Further, coma-free coils 15 are additionally arranged adjacent the circumference of the neck part of the coil separator 11, to compensate for coma which is generated by the vertical deflecting coils 16.

Moreover, in the saddle-saddle type deflection yoke and the saddle-toroid type deflection yoke, a printed circuit board 17 is positioned on a side of the coil separator 11, to supply power to the horizontal deflecting coils 12 and the vertical deflecting coils 13 and 16.

On an upper and a lower surface of a side of the coil separator 11, that is, corresponding to the pair of grooves 14*a* and 14*b* of the ferrite core 14, respectively, there is defined fluctuation preventing means which is to be fitted into the pair of grooves 14*a* and 14*b* for preventing the ferrite core 14 from fluctuating when the ferrite core 14 is coupled to the coil separator 11.

Especially, the fluctuation preventing means is formed such that it elastically supports inner surfaces of the pair of grooves 14*a* and 14*a* of the ferrite core 14, thereby to solve the problem associated with a change in the width of the pair of grooves 14*a* and 14*b* when the coupling of the ferrite core 14 to the coil separator 11 is completed, which may be caused in the course of manufacturing the ferrite core 14.

The fluctuation preventing means comprises two pairs of left and right elastic projections 400 and 500 which are formed such that the two pairs extend from an upper inside surface and a lower inside surface of the coil separator 11, respectively, with the two pairs corresponding to the pair of grooves 14*a* and 14*b*, respectively, formed in the ferrite core 14 and with the left and right elastic projections 400 and 500 of each pair extending parallel to each other, the two pairs of left and right elastic projections 400 and 500 being elastically fitted into the pair of grooves 14*a* and 14*b* of the ferrite core 14, respectively.

At this time, the left and right elastic projections 400 and 500 are spaced apart from each other by a desired distance, to properly compensate for dispersion, for example a dimensional tolerance which is owned by the ferrite core 14, when coupling the ferrite core 14 to the coil separator 11.

In other words, the left and right elastic projections 400 and 500 are spaced apart from each other by the desired distance, to compensate for tolerance dispersion of the pair of grooves 14*a* and 14*b*, which is generated in the course of forming the ferrite core 14.

Generally, the tolerance dispersion in the width of the pair of grooves 14*a* and 14*b* of the ferrite core 14 is $T \mp 0.1$ mm −1.0 mm, when T is width.

Accordingly, in order to elastically support the inner surfaces of the pair of grooves 14*a* and 14*b* of the ferrite core 14, the distance between the left and right elastic projections 400 and 500 must be no less than 1.0 mm.

By this embodiment of the present invention, due to the fact that the left and right elastic projections 400 and 500 are elastically fitted into the pair of grooves 14*a* and 14*b* when the ferrite core 14 is coupled to the coil separator 11, the ferrite core 14 can be stably prevented from being rotated or fluctuating.

At this time, since the left and right elastic projections 400 and 500 are elastically fitted into the pair of grooves 14*a* and 14*b* while having a desired distance therebetween which is no less than a tolerance dispersion range in the width of the pair of grooves 14*a* and 14*b* of the ferrite core 14, any ferrite cores 14 having pair of grooves 14*a* and 14*b* which have a tolerance range of 0.1 mm–1.0 mm, can be stably coupled to the coil separator 11. Specifically, it is possible to prevent the ferrite core 14 from being rotated or fluctuating after being coupled to the coil separator 11.

A deflection yoke in accordance with a fifth embodiment of the present invention will be described with reference to the first through fourth embodiments of the present invention.

FIGS. 2 and 3 illustrate the conventional saddle-saddle type deflection yoke. As can be seen from FIGS. 2 and 3, in the saddle-saddle type deflection yoke, horizontal deflection coils 12 having a saddle-shaped configuration are disposed on upper and lower portions of a circumferential inner surface of a screen part of a coil separator 11 having a substantially frusto-conical configuration, and vertical deflecting coils 13 having a saddle-shaped configuration are disposed on left and right portions of a circumferential outer surface of the screen part of the coil separator 11.

A ferrite core 14 having a substantially cylindrical configuration is placed on the circumferential outer surface of the screen part of the coil separator 11, to reinforce a magnetic field of the vertical deflecting coils 13.

Also, coma-free coils 15 are arranged adjacent the circumference of the neck part of the coil separator 11, that is, on a rear plate 11*a*, to compensate for coma which is generated by the vertical deflecting coils 13.

FIGS. 4 and 5 illustrate the conventional saddle-toroid type deflection yoke. As can be seen from FIGS. 4 and 5, in the saddle-toroid type deflection yoke, horizontal deflection coils 12 are disposed on upper and lower portions of a circumferential inner surface of a screen part of a coil separator 11 having a substantially frusto-conical configuration, a ferrite core 14 having a substantially cylindrical configuration is placed on a circumferential outer surface of the screen part of the coil separator 11, and vertical deflecting coils 16 having a toroid-shaped configuration are disposed on upper and lower portions of the ferrite core 14.

A pair of grooves 14*a* and 14*b* having a predetermined width and a predetermined depth are formed on central upper and lower surfaces of the ferrite core 14, respectively.

Further, coma-free coils 15 are additionally arranged adjacent the circumference of the neck part of the coil separator 11, to compensate for coma which is generated by the vertical deflecting coils 16.

Moreover, in the saddle-saddle type deflection yoke and the saddle-toroid type deflection yoke, a printed circuit board 17 as shown in FIG. 12 is positioned on a side of the coil separator 11, to supply power to the horizontal deflecting coils 12 and the vertical deflecting coils 13 and 16.

Referring to FIG. 12, insulating means is defined on an inside surface of the coil separator 11, to prevent one end and the other end of the horizontal deflecting coil 12 connected to the printed circuit board 17 from being brought into contact with each other, that is, to prevent a short from being generated.

Coil distance maintaining means is defined on an outer surface of the coil separator 11 to secure a safe distance between the horizontal and vertical deflecting coils 12 and 13, that is, to prevent the horizontal and vertical deflecting coils 12 and 13 from being brought into contact with each other.

The above mentioned insulating means is provided between boundary surfaces of coil separator halves which are assembled with each other to complete the coil separator 11. As the insulating means, as shown in FIG. 12, a separating piece 100 is formed on one boundary surface of one coil separator half such that it extends toward the other boundary surface of the other coil separator half.

Accordingly, since one end and the other end of the horizontal deflecting coil 12 are connected to the printed circuit board 17 in a state that they are separated over and under while centering around the separating piece 100, it is possible to prevent a short and an electric shock due to a contact between one end and the other end of the horizontal deflecting coil 12, which can be otherwise generated in a coil connecting process.

When deliberating a detailed construction of the coil distance maintaining means for securing a safe distance between the horizontal and vertical deflecting coils 12 and 13, as shown in FIGS. 13 and 14, an isolating piece 200 extends from the outer surface of the coil separator 11 by a predetermined distance.

At this time, the isolating piece 200 is formed such that the predetermined distance is maintained between it and an outer surface of the rear plate 11*a* of the coil separator 11.

Accordingly, by causing the horizontal deflecting coils 12 and the vertical deflecting coils 13 to be guided on the outer surface of the rear plate 11*a* and an outer surface of the isolating piece 200, respectively, a safe distance can be sufficiently secured between the horizontal deflecting coils 12 and the vertical deflecting coils 13.

On an upper and a lower surface of a side of the coil separator 11, that is, corresponding to the pair of grooves 14*a* and 14*b* of the ferrite core 14, respectively, there is defined fluctuation preventing means which is to be fitted into the pair of grooves 14*a* and 14*b* for preventing the ferrite core 14 from fluctuating when the ferrite core 14 is coupled to the coil separator 11.

Especially, the fluctuation preventing means is formed such that it elastically supports inner surfaces of the pair of grooves 14*a* and 14*a* of the ferrite core 14, thereby to solve the problem associated with a change in the width of the pair of grooves 14*a* and 14*b* when the coupling of the ferrite core 14 to the coil separator 11 is completed, which may be caused in the course of manufacturing the ferrite core 14.

The fluctuation preventing means comprises two pairs of left and right elastic projections 400 and 500 which are formed such that the two pairs extend from an upper inside surface and a lower inside surface of the coil separator 11, respectively, with the two pairs corresponding to the pair of grooves 14*a* and 14*b*, respectively, formed in the ferrite core 14 and with the left and right elastic projections 400 and 500 of each pair extending parallel to each other, the two pairs of left and right elastic projections 400 and 500 being elastically fitted into the pair of grooves 14*a* and 14*b* of the ferrite core 14, respectively.

At this time, the left and right elastic projections 400 and 500 are spaced apart from each other by a desired distance, to properly compensate for dispersion, for example a dimensional tolerance which is owned by the ferrite core 14, when coupling the ferrite core 14 to the coil separator 11.

In other words, the left and right elastic projections 400 and 500 are spaced apart from each other by the desired distance, to compensate for tolerance dispersion of the pair of grooves 14*a* and 14*b*, which is generated in the course of forming the ferrite core 14.

Generally, the tolerance dispersion in the width of the pair of grooves 14*a* and 14*b* of the ferrite core 14 is $T \mp T0.1$ mm −1.0 mm when T is width.

Accordingly, in order to elastically support the inner surfaces of the pair of grooves 14*a* and 14*b* of the ferrite core

14, the distance between the left and right elastic projections 400 and 500 must be no less than 1.0 mm.

As described above, by the present invention, winding operations of the horizontal and vertical deflecting coils 12 and 13 and leading operations thereof to the printed circuit board 17 can be stably performed through the separating piece 100 and the isolating piece 200 which are defined on the coil separator 11, and specifically, a short and an electric shock can be prevented from being generated.

In addition, due to the fact that fluctuation and rotation of the ferrite core 14 in a coupling direction, which may be generated when the ferrite core 14 is coupled to the outer surface of the coil separator 11, are prevented through the left and right elastic projections 400 and 500 defined on the coil separator 11, picture dispersion can be improved.

As a result, since a difference between left and right magnetic fields due to relative dispersion between the horizontal deflecting coil 12 and the vertical deflecting coil 13 and/or relative current amount, and mis-convergence and geometrical distortion (G/D) due to the difference can be prevented, reliability of the deflection yoke 10 and the cathode ray tube 1 can be elevated.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A deflection yoke comprising:

a coil separator having a rear plate and a neck part which are defined therein and a printed circuit board which is positioned on a side thereof;

at least one horizontal deflecting coil disposed on a circumferential inner surface of the coil separator to produce a horizontal magnetic field and connected to the printed circuit board;

at least one vertical deflecting coil disposed on a circumferential outer surface of the coil separator to produce a vertical magnetic field;

a ferrite core positioned on the circumferential outer surface of the coil separator to reinforce the horizontal and vertical magnetic fields of the horizontal and vertical deflecting coils and having at least one pair of grooves of a predetermined width, which are formed on central upper and lower surfaces thereof; and fluctuation preventing means defined on the coil separator as a projecting element of predetermined elasticity, which extends into an along the grooves to elastically support inner surfaces of the pair of grooves of the ferrite core to prevent the ferrite core from fluctuating when the ferrite core is positioned on the coil separator.

2. A deflection yoke as claimed in claim 1, wherein the fluctuation preventing means comprises ate last two pairs of opposed elastic walls which are formed to extend along the respective groove from a surface of the coil separator which is inside the ferrite core, with two elastic projections of each pair extending parallel to each other, the two pairs of elastic projections being fitted into the pair of grooves of the ferrite core, respectively, to compensate for a width tolerance range of 0.1 mm–1.0 mm, which each groove of the ferrite core has.

3. A deflection yoke comprising:

a coil separator having a rear plate and a neck part which are defined therein and a printed circuit board which is positioned on a side thereof;

at least one horizontal deflecting coil disposed on a circumferential inner surface of the coil separator to produce a horizontal magnetic field and connected to the printed circuit board;

at least one vertical deflecting coil disposed on a circumferential outer surface of the coil separator to produce a vertical magnetic field;

a ferrite core positioned on the circumferential outer surface of the coil separator to reinforce the horizontal and vertical magnetic fields of the horizontal and vertical deflecting coils and having at least on pair of grooves of a predetermined width, which are formed on central upper and lower surfaces thereof;

insulating means defined on an inside surface of the coil separator to prevent a short from being generated due to a contact between one end and the other end of the horizontal deflecting coil connected to the printed circuit board;

coil distance maintaining means defined on an outer surface of a side of the coil separator to secure a safe distance between the horizontal and vertical deflecting coils; and fluctuation preventing means defined on the coil separator as a projecting element of predetermined elasticity, which extends into and along the grooves to elastically support inner surfaces of the pair of grooves of the ferrite core to prevent the ferrite core from fluctuating when the ferrite core is positioned on the coil separator.

4. A deflection yoke as claimed in claim 3, wherein the coil separator has boundary surface and insulating means is provided between the boundary surfaces of coil separator halves which are assembled with each other.

5. A deflection yoke as claimed in claim 3, wherein the coil separator has boundary surfaces and insulating means comprises a separating piece which is formed on one boundary surface of one coil separator half such that it extends toward the other boundary surface of the other coil separator half, to separate over and under different ends of the horizontal deflecting coil.

6. A deflection yoke as claimed in claim 3, wherein the coil distance maintaining means comprises an isolating piece which is formed on an outer surface of a side of a plate of the coil separator plate to extend from an outer surface of the rear plate while maintaining a predetermined distance therefrom, to isolate the horizontal and vertical deflecting coils from each other.

7. A deflection yoke as claimed in claim 3, wherein the fluctuation preventing means comprises at least two pairs of opposed elastic walls which are formed to extend along the respective groove from a surface of the coil separator which is inside the ferrite core, with two elastic projection of each pair extending parallel to each other, the two pairs of elastic projection being fitted into the pair of grooves of the ferrite core, respectively, to compensate for a width tolerance range of 0.1 mm–1.0 mm, which each groove of the ferrite core has.

* * * * *